United States Patent [19]

Denkinger et al.

[11] 4,101,106

[45] Jul. 18, 1978

[54] CUSHION LEVELER FOR TABLES AND CHAIRS

[76] Inventors: Marian C. Denkinger, 88-35 Elmhurst Ave., Elmhurst, N.Y. 11373; Kemal Batova, 1607 N. Belmore Ave., Staunton, Va. 24401

[21] Appl. No.: 680,881

[22] Filed: Apr. 27, 1976

[51] Int. Cl.[2] ..... F16M 11/20

[52] U.S. Cl. ..... 248/188.9; 248/24; 248/358 R

[58] Field of Search ..... 248/22, 24, 188.9, 205 A, 248/358 R

[56] References Cited

U.S. PATENT DOCUMENTS

| | | | |
|---|---|---|---|
| 938,504 | 11/1909 | Nodine | 248/24 |
| 1,388,967 | 8/1921 | Noble | 248/22 |
| 3,043,049 | 7/1962 | Gleason | 248/188.2 |
| 3,311,338 | 3/1967 | Culley | 248/205 A |
| 3,351,027 | 11/1967 | Ellard et al. | 248/358 R |
| 3,425,652 | 2/1969 | Leary | 248/22 |
| 3,679,159 | 7/1972 | Bach et al. | 248/22 |
| 3,721,096 | 3/1973 | Deckert et al. | 248/22 |
| 4,015,808 | 4/1977 | Carroll | 248/24 X |

FOREIGN PATENT DOCUMENTS

| | | | |
|---|---|---|---|
| 16,249 | 7/1911 | United Kingdom | 248/188.9 |
| 601,821 | 5/1948 | United Kingdom | 248/22 |
| 951,816 | 7/1962 | United Kingdom | 248/24 |

*Primary Examiner*—Lawrence J. Staab
*Attorney, Agent, or Firm*—Allison C. Collard

[57] ABSTRACT

This invention is concerned with a device for application to the feet of tables, chairs, desks, stands, files, etc., generally any surface to be levelled, to allow for the minor discrepancies of their not being in the same plane, or for minor discrepancies in the plane of a floor, so that the device can automatically and differentially correct for the degree of difference among the three or four legs of the table or chair, or the supporting surface which contacts the floor.

1 Claim, 5 Drawing Figures

CUSHION LEVELER FOR TABLES AND CHAIRS

THE BACKGROUND OF THE INVENTION:

It is common experience that a chair or a table will not rest firmly on the floor. The problem is usually attributable to a difference in the plane reached by the ends of the chair legs. A difference of a small fraction of an inch is readily sensed in that the four-legged table will not rest stably in position. A cummulative error is attributable to the floor. If the base of the table or chair is a disk, or rug, the error is also sensed. That is, there can be differences in the plane of the floor within the area spanned by the table or chair feet or base, which differences are sensed by the user of the table, or the chair, through a rocking of the table or the chair. Improvisations are many. The usual one in a restaurant is a match book or folded napkin slipped under a table leg. Corrections if left to the cabinet maker are difficult because it is necessary to bring the item to a work shop and level it accurately there. This has the attendant disadvantage that this kind of precision work can easily be destroyed in the process of redelivering the table or chair to its place of use. Rough handling, a slight distortion of a joint, and the error is as bad as it ever was.

It is the basic object of the invention to promote a device useful under tables, chairs, etc., to correct automatically for errors in the level of the device or plane.

A BRIEF STATEMENT OF THE INVENTION

This invention is directed to a device which is directly applicable to the feet of the table or a chair, or other furniture, the device being in the form of a blister, automatically self-correcting, with the weight of the chair or table, to the precise degree needed to cause the table or the chair to rest stably on the floor, despite even a compounded error caused by the legs of the table or chair floors being non-planar.

The invention accordingly is in a blister-type device consisting of a plastic deformable bubble, planar on two opposite faces, said faces being parallal, curvilinear in its circumference, equipped with means on a face thereof to permit application, the whole constituting a completely sealed bubble unit, the plastic material having an elastic lag such that it deforms in response to the amount of weight applied thereto, but will return to original form with release of that weight, the whole being formed as a single unitary bubble, one for each leg of a table or a chair and, in a modification thereof, the device being formed essentially as a torus having a central indentation suitable to receive a screw, in which form it is useful as a washer in plumbing applications.

IN THE DRAWING

Figure 1:
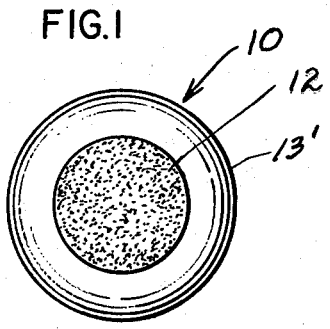
FIG. 1 represents a top plan view of the device.
Figure 2:
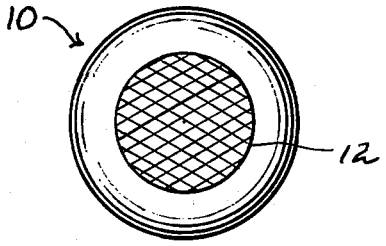
FIG. 2 represents a bottom plan view of the device.
Figure 3:
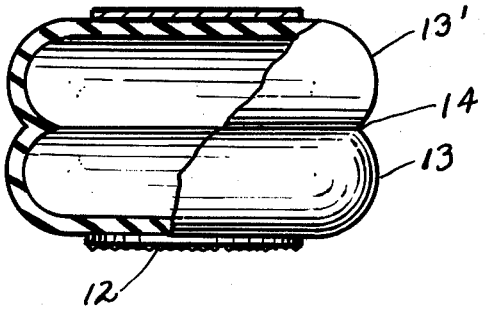
FIG. 3 represents a longitudinal section of the device.
Figure 4:
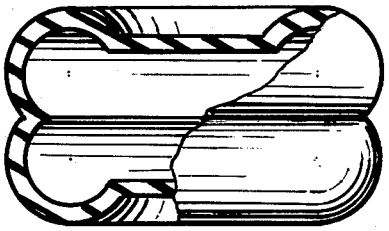
FIG. 4 represents a side elevation of the device.

Referring now to FIGS. 1, 2 and 3. FIGS. 1, 10, represents the device generally which consists of a top patch, 11, and a bottom patch, 12, with side walls, 13, preferably formed as a dual blister, 13, 13', with a mid-peripheral indentation, 14.

Figure 5:
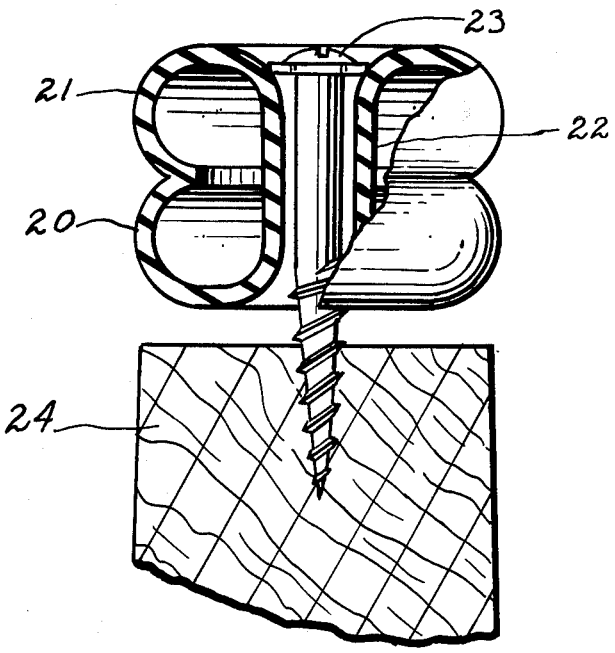
FIG. 5 represents the torus form of the device, with a screw in place, indicating how it is applicable to the base of a valve, or the foot of a chair, depending on the preference of the user.

In FIG. 5, it will be apparent that the device is formed as a torus, 20, having a circumferential indentation, 21, so, effectively, it is a double torus having a central diametrical opening, 22, capable of receiving a screw, 23, for mounting into a table leg or chair, or valve stem, 24. When used as a valve stem the cushion automatically corrects for any inaccuracy in the foot of the valve and the stem which it faces.

In the fabrication of these devices, the simple blow molding technique is all that is necessary. Since blow molding is the technique commonly used for the fabrication of plastic containers, bottles and the like, there is no need to elaborate on it here, and such techniques may be considered incorporated herein by reference to that extent.

The materials of construction are preferably polyethelene, or polypropylene, or polytetrafluorethylene, or polyvinylchloride. When it is desired to get to a genuinely superior material. For routine purposes, for use on tables and chairs, the polyethelene, polypropelene blister of about the weight used in conventional liquid containers is suitable, that is the wall need not be more than 0.005 to 0.015 inch in thickness.

For the adhesive, any of the formulations commonly used for pressure sensitive application of devices on tiles and the like can be used. It should also be apparent that hot melt adhesives are quite useful, particularly where they can be applied by means of a gun, the gun serving to melt the adhesive, apply a spot to the chair, which spot then holds the blister in place.

In use it will be apparent that the blister with the elastic lag properties indicated will accept the differential weight applied to the table or the chair and cause the surface of the table to maintain a stable level. It need not be perfectly level, but it will be stable, because the distribution of weight will cause a proportional deformation of the blister and equilibrium will thus be reached. Similarly, when a person sits in a chair thus equipped any maldistribution of weight induced by a differential in the length of the legs will cause similar distribution of distortion in the blisters, giving stability to a chair which otherwise would rock under the user.

It will be apparent from the foregoing that variations in the shape of the object may be made without departing from the spirit or scope of the invention, which is not to be restricted other than as defined in the following claims.

The device is useful as a cushion under chairs to protect floor finishes and carpet, eventhough it is not functioning as a leveler.

What is claimed is:

1. A device for levelling a piece of furniture, such as a table or chair, on a floor, so that the piece of furniture will maintain a stable equilibrium relative to unevenness in the piece of furniture or the floor comprising;

a double torus-shaped closed blister being filled with air, said blister being formed of deformable plastic material having an elastic lag with a memory of its formed shape, said blister having upper and lower faces;

means for attaching said blister to a foot of a piece of furniture with one of its faces in abutment therewith; and said blister having a central diametrical opening extending therethrough and said device additionally including a screw receivable and mountable within said opening for attaching said blister to a foot of a piece of furniture.

* * * * *